United States Patent [19]

Romanauskas

[11] Patent Number: 4,511,350

[45] Date of Patent: Apr. 16, 1985

[54] SUSPENSION SYSTEM FOR A CENTRIFUGE ROTOR

[75] Inventor: William A. Romanauskas, Southbury, Conn.

[73] Assignee: E. I. Du Pont de Nemours and Company, Wilmington, Del.

[21] Appl. No.: 539,364

[22] Filed: Oct. 6, 1983

[51] Int. Cl.[3] ..... B04B 9/14

[52] U.S. Cl. ..... 494/82; 494/84; 494/85

[58] Field of Search ..... 74/411; 464/98, 99, 464/150; 474/94; 494/82, 84, 85

[56] References Cited

U.S. PATENT DOCUMENTS

| | | | |
|---|---|---|---|
| 2,630,692 | 3/1953 | Naugler | 464/99 |
| 3,664,151 | 5/1972 | Pause | 494/84 |
| 3,961,745 | 6/1976 | Wright | 494/84 |
| 4,096,711 | 6/1978 | Carlson | 464/99 |
| 4,203,304 | 5/1980 | Decker | 464/99 |

*Primary Examiner*—Robert W. Jenkins
*Assistant Examiner*—Arthur D. Dahlberg

[57] ABSTRACT

A suspension system for a rotor includes a coupling having a rigid shaft portion flexibly linked at two connection points to the rotor and to a drive spindle therefor.

1 Claim, 2 Drawing Figures

SUSPENSION SYSTEM FOR A CENTRIFUGE ROTOR

BACKGROUND OF THE INVENTION

1. Field of the Invention

This invention relates to a centrifuge rotor and, in particular, to a suspension system for a centrifuge rotor.

2. Description of the Prior Art

An important consideration when using a centrifuge apparatus is insuring that the load carried by the rotor is in balance with respect thereto. This concern is well-founded since, as rotational speed increases through the critical value, rotor unbalance manifests itself as vibration. Depending upon the magnitude of the unbalance, such vibration may be sufficient to damage the centrifuge apparatus.

For a rotating body, such as a centrifuge rotor, to pass through its critical speed, two events must occur simultaneously. First, the rotor's principle axis, the axis through the rotor's center of gravity, must lie parallel to the rotor's spin axis, the axis passing through the geometric center of the rotor. Second, the rotor's center of gravity must lie on the spin axis. If these two events were enabled to occur more quickly after rotor start-up, then the rotor would pass through its critical speed at an earlier time (i.e., at a lower speed) thus reducing the vibration caused by a given amount of rotor unbalance.

In view of the foregoing it would be advantageous to provide a centrifuge that would maintain vibratory forces at a minimum, thus increasing the amount of unbalance that the centrifuge would be able to tolerate. One manner of accomplishing this end is to reduce the critical speed of the rotor. By lowering the rotor's critical speed, the vibration imposed on the centrifuge by a given rotor unbalance is commensurately reduced.

SUMMARY OF THE INVENTION

In accordance with this invention a suspension system for a centrifuge rotor having a weight W is provided which makes satisfaction of each of the two conditions for the attainment of critical speed independent of each other. As a result, the critical speed of the rotor is lowered. The rotor suspension system embodying the teachings of this invention comprises a coupling member having a first and a second collar each flexibly connected to a rigid shaft. The rigid shaft has a dimension L. The first collar is flexibly connected at a first connection point "r" to the centrifuge rotor while the second collar is flexibly connected to the rotor drive member at a second connection point "d". One of the flexible joints is thus disposed a predetermined distance A from the center of gravity of the rotor. The flexible connections of the coupling exhibit predetermined torsional stiffness $K_d$ and $K_r$ at their respective points of connection to the drive or the rotor.

In accordance with this invention the distance A is defined by the relationship:

$$A = \frac{L \cdot K_r}{K_r + K_d + L \cdot W} \quad (1)$$

where $K_r$ is the torsional stiffness at the flexible connection of the coupling to the rotor at the connection point "r";

$K_d$ is the torsional stiffness at the flexible connection of the coupling to the rotor drive at the connection point "d";

A is the distance that the center of gravity of the rotor lies from the connection point "r";

L is the length of the rigid shaft; and

W is the weight of the rotor.

With the suspension system of the present invention, the satisfaction of the individual conditions necessary to make attainment of critical speed is made independent of each other, and the rotor's critical speed is then a function of the torsional stiffnesses of the coupling, the weight W of the rotor, and the length L of the rigid shaft.

BRIEF DESCRIPTION OF THE DRAWINGS

The invention may be more fully understood from the following detailed description thereof taken in connection with the accompanying drawings, which form a part of this application, and in which.

DETAILED DESCRIPTION OF THE INVENTION

Figure 1:
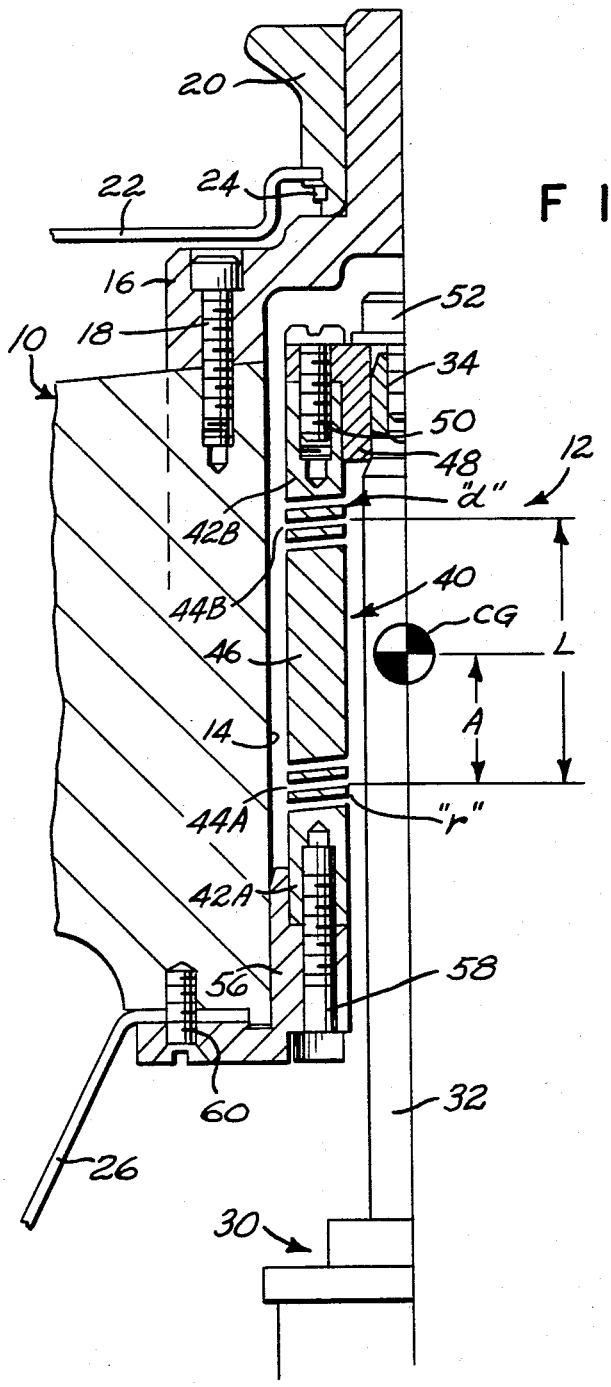
FIG. 1 is a side elevational view entirely in section of a rotor suspension arrangement in accordance with the present invention.

Throughout the following detailed description similar reference numerals refer to similar elements in all Figures of the drawings.

Shown in FIG. 1 is a side elevational view entirely in section of a centrifuge rotor 10 having a suspension system generally indicated by reference character 12 embodying the teachings of this invention. Since the suspension system 12 may be used with any well-known rotor configuration, the rotor 10 is illustrated only fragmentally. The center of gravity of the rotor is diagrammatically indicated by the character CG. The rotor 10 has a central bore 14 with a suitable top cap 16 secured thereover as by threaded bolts 18. The central projection of the top cap 16 is sized to receive a central aperture of a rotor cover knob 20. A generally disc-like rotor cover 22 is secured about the lower periphery of the knob 20 and is held in position at that point by any suitable lock ring 24 as well understood by those skilled in the art. The rotor 10 may be further provided with a windshield 26. The windshield 26 is fragmentally indicated in the drawings and is conveniently secured to the rotor 10 in a manner to be discussed herein.

Motive force for the rotor is derived from a rotor drive arrangement 30 which includes a drive spindle 32 projecting upwardly into the central bore 14. The upper end of the drive spindle 32 is provided with a threaded recess 34 for a purpose described herein.

The suspension system 12 in accordance with the present invention includes a substantially annular coupling member generally indicated by the reference character 40. The coupling member includes first and second collar portions 42A and 42B, respectively. The collars are flexibly connected through suitable flexible links 44A and 44B to each end of a substantially rigid shaft portion 46. The shaft 46 has a length L while the center of gravity CG of the rotor 10 lies a distance A from one of the flexible links 44. The flexible links 44A and 44B have torsional stiffnesses $K_r$ and $K_d$ respectively associated therewith.

In practice the collars, flexible links, and rigid shaft are fabricated as a unitary member such as that provided by Heli-cal TM rotating shaft flexible couplings such as those sold by Heli-cal Products Company, Inc. Although such flexible couplings are preferred, any other flexible shaft coupling may be utilized.

The collar 42B is secured to a drive adapter 48 by a threaded bolt 50. The drive adapter 48 is itself secured at the upper end of the drive spindle 32 by a capped bolt 52 which is received within the threaded recess 34 of the spindle 32. Similarly, the collar 42A is connected to a ring 56 by a threaded bolt 58. The ring 56 is itself secured to the rotor by a threaded bolt 60. The bolt 60 extends through the outward portion of the ring 56 and serves to secure not only the ring 56 but also the central portion of the windshield 26 to the under surface of the rotor 10.

Figure 2:
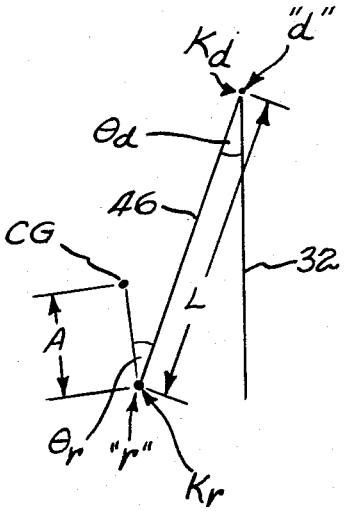
FIG. 2 is a force diagram illustrating the forces acting upon the rotor suspension arrangement in accordance with the present invention.

As may be better understood by reference to the force diagram shown in FIG. 2, the above-described suspension system serves to suspend the rotor 10 to the drive spindle 32 at two substantially flexible connection points indicated in the drawings as connection points "r" and "d". As seen with reference to FIG. 1, connection point "r" is that flexible connection point adjacent the connection of the coupling 40 to the rotor 10 as defined by the flexible link 44A between the rigid shaft 46 and the collar 42A. Similarly, the connection point "d" is defined at the flexible connection point adjacent to the connection of the coupling 40 to the drive spindle 32 defined by the flexible link 44B which extends between the rigid shaft 46 and the collar 42B.

As noted earlier, the rotor's critical speed is that rotational speed at which two events simultaneously occur. These events are, firstly, the parallel alignment of the principal axis of the rotor (an axis extending through the rotor center of gravity CG) and the spin axis of the rotor (that is, an axis through the geometric center of the rotor). Secondly, the rotor's center of gravity CG must lie on the spin axis. By making the satisfaction of these two conditions independent of each other it is possible to permit the rotor to attain its critical speed at a lower rotational speed. As a consequence vibratory forces imposed on the rotor by a given rotor unbalance are lessened. Thus, the rotor may be enabled to tolerate larger amounts of rotor unbalance.

The suspension system 12 in accordance with the present invention isolates and makes independent the satisfaction of the above two conditions imposed on a rotor enabling it to reach its critical speed. The suspension system 12 acts generally as a kinematic equivalent of an infinite pendulum. As seen in the force diagram of FIG. 2, in order that the above two conditions be independently achieved, the angle $\theta_d$ must at all times be made to equal the angle $\theta_r$.

In accordance with this invention the distance A is defined by the following relationship:

$$A = \frac{L \cdot K_r}{K_r + K_d + L \cdot W} \quad (1)$$

where $K_r$ is the torsional stiffness at the flexible connection of the coupling to the rotor at the connection point "r";

$K_d$ is the torsional stiffness at the flexible connection of the coupling to the rotor drive at the connection point "d";

A is the distance that the center of gravity of the rotor lies from the connection point "r";

L is the length of the rigid shaft; and

W is the weight of the rotor.

Utilizing the suspension system of the present invention, as noted earlier, provides the kinematic equivalent of an infinite pendulum. Thus, the application of a force to the rotor acting through its center of gravity will result only in the deflection of the rotor. Simultaneously, a restoring couple imposed upon rotor will result only in the tilting of the rotor. In this way, the rotor's critical speed becomes a function only of the torsional stiffnesses of the couplings, the weight of the rotor, and the length of the shaft.

Those skilled in the art having the benefit of the present teachings may effect numerous modifications thereto. These modifications are, however, to be construed as lying within the scope of the present invention as defined by the appended claims.

What is claimed is:

1. In a centrifuge having a rotor with a weight W and a drive member connectable to the rotor the improvement comprising a suspension system for mounting the rotor to the drive member, the suspension system comprising a coupling having a first and a second collar each connected by a flexible link to a rigid shaft, one collar being connected at a connection point "r" to the rotor such that the rotor's center of gravity lies a predetermined distance A above the connection point "r" and the second collar being connected at a second connection point "d" to the shaft, the rigid shaft having a length L, the flexible link adjacent the connection point "r" having a torsional stiffness $K_r$ associated therewith while the flexible link adjacent the connection point "d" having a torsional stiffness $K_d$ associated therewith, the distance A being defined by the relationship:

$$A = \frac{L \cdot K_r}{K_r + K_d + L \cdot W}$$

* * * * *